US005956996A

United States Patent [19]

Nara et al.

[11] Patent Number: 5,956,996

[45] Date of Patent: Sep. 28, 1999

[54] ASSEMBLING ARRANGEMENT FOR ENGINE STARTERS

[75] Inventors: Koji Nara, Maebashi; Masaaki Ohya, Isesaki; Yoshikazu Sato, Fukaya; Michio Okada, Gunma; Shinichi Nagashima, Ashikaga; Eiichi Kimura, Kiryu, all of Japan

[73] Assignee: Mitsuba Corporation, Gunma-ken, Japan

[21] Appl. No.: 08/942,776

[22] Filed: Oct. 2, 1997

[30] Foreign Application Priority Data

Oct. 17, 1996 [JP] Japan ..... 8-297459

[51] Int. Cl.[6] ..... F02N 11/00

[52] U.S. Cl. ..... 74/7 R; 74/7 E; 74/7 B; 29/606; 29/602.1; 335/126; 335/131; 310/89

[58] Field of Search ..... 74/7 R, 7 E, 7 B; 310/83, 89; 290/48, 38 A, 38 B, 38 C, 38 R; 29/606, 602.1; 335/126, 131

[56] References Cited

U.S. PATENT DOCUMENTS

| | | | |
|---|---|---|---|
| 4,262,546 | 4/1981 | Mazzorana | 74/7 A |
| 4,404,533 | 9/1983 | Kurihara et al. | 335/131 |
| 4,663,979 | 5/1987 | VanSickle | 74/7 A |
| 4,838,100 | 6/1989 | Tanaka | 335/126 |
| 5,118,960 | 6/1992 | Sasamoto et al. | 290/48 |
| 5,521,566 | 5/1996 | Krubsack et al. | 335/126 |
| 5,760,487 | 6/1998 | Kimura et al. | 290/48 |

FOREIGN PATENT DOCUMENTS

| | | | |
|---|---|---|---|
| 3903-846 | 8/1989 | Germany | 74/7 E |

*Primary Examiner*—Tamara L. Graysay
*Assistant Examiner*—William C Joyce
*Attorney, Agent, or Firm*—Skjerven, Morrill, MacPherson, Franklin & Friel LLP; Alan H. MacPherson; Hugh H. Matsubayashi

[57] ABSTRACT

In an engine starter, to facilitate the assembling of a solenoid assembly, an annular outer peripheral wall is formed in the casing for receiving the energization solenoid assembly and to secure the solenoid assembly by crimping a free end of the annular outer peripheral wall onto an axial end of the solenoid assembly, and the energization solenoid assembly is fitted into the bore defined by the annular outer peripheral wall by engaging the outer periphery of the solenoid assembly with three fingers of an assembly tool. A plurality of crimping portions are defined by a plurality of recesses provided along the circumferential direction of the free end of the annular outer peripheral wall so that the fingers of an assembling tool when inserting the solenoid assembly are not interfered by the annular outer peripheral wall.

7 Claims, 4 Drawing Sheets

ASSEMBLING ARRANGEMENT FOR ENGINE STARTERS

TECHNICAL FIELD

The present invention relates to an engine starter, and in particular to an assembling arrangement for engine starters including a solenoid assembly fitted into a pinion casing.

BACKGROUND OF THE INVENTION

According to a conventional automotive engine starter, an electric motor and a magnet switch solenoid assembly are coaxially arranged in a series, and an output shaft extending coaxially from the motor is passed through the bore of the tubular solenoid assembly so that a pinion gear mounted on a free end of the output shaft may mesh with a ring gear.

In this arrangement, because the magnetic switch solenoid assembly is received in a casing which is attached to the output shaft end of the motor, the solenoid assembly is required to be fitted into the casing in the axial direction, and it is desired to simplify the assembling work for the solenoid assembly. It is possible, for instance, to use a special tool having a plurality of fingers that can be opened and closed in the radial direction. The outer peripheral part of the cylindrical solenoid assembly may be radially held by the free ends of the fingers while the solenoid assembly is being inserted into the casing. Once the solenoid assembly is placed in the casing, the fingers are opened up to release the solenoid assembly.

To secure the solenoid assembly in the casing, the casing may be provided with an annular shoulder for engaging the front end of the solenoid assembly as seen in the direction of inserting the solenoid assembly, and an annular peripheral wall surrounding the solenoid assembly. In this case, the solenoid assembly is positioned with respect to the direction of inserting the solenoid assembly by abutting the inserted solenoid assembly onto the annular shoulder surface, and is fixedly secured by crimping an axial free end of the annular outer peripheral wall onto the rear end of the solenoid assembly as seen in the direction of inserting the solenoid assembly.

However, according to this arrangement, because the parts of the fingers engaging the solenoid assembly interfere with the end portion of the annular outer peripheral wall, the solenoid assembly engaging portions of the fingers cannot keep engaging the solenoid assembly until the solenoid assembly abuts onto the annular shoulder during the process of inserting the solenoid assembly, and the solenoid assembly must be released before the completion of the process of inserting the solenoid assembly so that the solenoid assembly may not be properly positioned at the prescribed position in the casing.

BRIEF SUMMARY OF THE INVENTION

In view of such problems of the prior art, a primary object of the present invention is to provide an engine starter which is adapted to be assembled in a both reliable and simple manner.

A second object of the present invention is to provide an improved assembling arrangement for starter motors which requires a minimum modification to the existing arrangement of the starter motor.

A third object of the present invention is to provide an assembling arrangement for starter motors which is adapted to an automated assembling process.

According to the present invention, these and other objects can be accomplished by providing an engine starter comprising an electric motor, a pinion housing attached to an axial end of the electric motor, and an annular cylindrical solenoid assembly fitted in the pinion casing; the pinion casing, comprising: an open end adapted to be attached to the electric motor; an annular wall having a base end secured to the pinion casing and extending axially toward the electric motor, the annular wall defining an inner bore receiving the solenoid assembly; and stopper means for limiting movement of the solenoid assembly away from the open end of the pinion casing; wherein a free end of the annular wall is provided with a plurality of recesses, and remaining parts of the free end of the annular wall are at least partly crimped onto an axial end of the solenoid assembly facing the open end of the pinion casing. Typically, the electric motor is provided with a planetary gear reduction unit having an output shaft passed coaxially into the casing so that the annular wall is disposed coaxially with the electric motor.

Thus, fingers for holding the outer periphery of the solenoid assembly is prevented by the recesses from being interfered by the annular wall surrounding the solenoid assembly, and the solenoid assembly can be held firmly until the completion of the process of inserting the solenoid assembly. Therefore, the assembling work can be carried out in a reliable fashion, and is well suited for an automatic assembling process. To define the extent to which the solenoid assembly may be fitted into the annular wall in a simple but reliable manner, the stopper means may comprise an annular shoulder integrally and coaxially defined in the annular wall to engage another axial end of the solenoid device facing away from the open end of the pinion casing. Alternatively or additionally, the solenoid device may be provided with an external radial flange near an axial end thereof facing the open end of the pinion casing while the stopper means comprises an annular shoulder integrally and coaxially defined in a part of the annular wall adjacent to the free end thereof to engage external radial flange.

To minimize any change to the existing assembling arrangement of the engine starter, the annular wall may comprise a relatively thin-walled section, and a relatively thick-walled section, the thick-walled section being formed with a bore for receiving a threaded bolt for attaching the pinion casing to the electric motor.

In any assembling process, it is desirable to provide means for preventing any improper assembling work. In this case, for instance, one of the fingers for holding the solenoid assembly may be made broader than the others, and at least one of the recesses may have a broader circumferential width than remaining ones of the recesses so that the angular orientation of the casing with respect to the fingers may be ensured by the fact that the broader finger can fit into only the broader recess.

According to a preferred embodiment of the present invention, the pinion casing comprises a large diameter portion which defines a substantially continuous outer profile with the electric motor, a small diameter portion which includes the annular wall and an extension therefrom having a tapered forward end rotatably supporting an output shaft of the engine starter carrying a pinion, and a mounting flange integrally formed around a forward end portion of the large diameter portion, the large diameter portion and the small diameter portion being integrally joined by an annular web extending substantially in a same plane as the mounting flange. This configuration is advantageous because it is suited to be formed by casting, provides a high mechanical strength, and provides a convenient arrangement for mounting the solenoid assembly.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
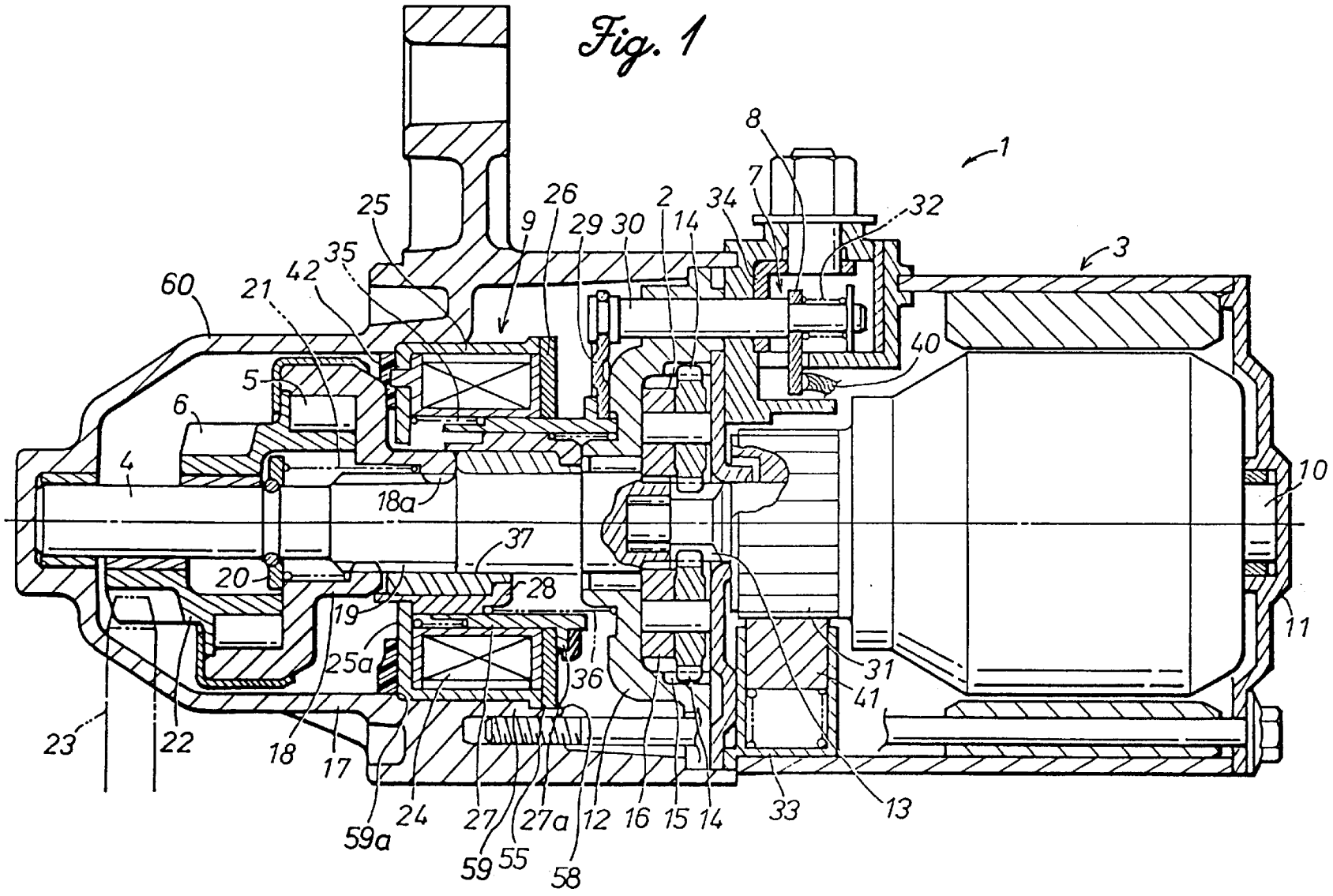
FIG. 1 is a longitudinal sectional view of an engine starter equipped with a reduction gear unit constructed according to the present invention.

FIG. 1 generally illustrates an engine starter equipped with a reduction gear unit which is constructed according to the present invention, and the upper half of the drawing illustrates the starter at its inoperative state while the lower half of the drawing illustrates the starter at its operative state. This starter 1 produces a torque which is necessary for cranking and starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line leading to the electric motor 3, and a solenoid device 9 for axially moving a moveable contact plate 8 of the switch unit 7 as well as the pinion 6.

The electric motor 3 consists of a known commutator type DC electric motor, and its rotor shaft 10 is pivotally supported in a central recess of a dish-shaped bottom plate 11 at its right end as seen in the drawing. A right end portion of the output shaft 4, as seen in the drawing, which is disposed coaxially with the rotor shaft 10 is pivotally supported by a top plate 12 of the motor 3, and a recess provided in an end surface of a right end portion of the output shaft 4 rotatably supports a left end portion of the rotor shaft 10 as shown in the drawing.

The reduction gear unit 2 is provided in a recess defined on the inner surface of the dish-shaped top plate 12 . The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 formed along the outer periphery of the recess defined on the inner surface of the top plate 12 to mesh with the planetary gears 14. A support plate 16 supporting the planetary gears 14 is attached to the right end of the output shaft 4.

To the top plate 12 is attached a pinion housing 17 which also serves as a securing bracket for mounting the starter to the engine. The inner surface of a central part of the tapered forward end (the left end as seen in the drawing) of the casing 17 rotatably supports a left end portion of the output shaft 4.

The outer circumferential surface of a middle part of the output shaft 4 engages the inner circumferential surface of a clutch outer member 18 of the one-way roller clutch 5 via a helical spline 19. The clutch outer member 18 is normally urged toward the electric motor 3 by a return spring 21 interposed between an engagement portion 18*a* with respect to the output shaft 4 via the helical spline 19 and a stopper plate 20 secured to a left end portion of the output shaft 4. The return spring 21 is coiled and received in an annular gap defined between an inner peripheral surface of the one-way roller clutch 5 and the outer surface of the output shaft 4.

The clutch outer member 18 engages a clutch inner member 22 of the one-way roller clutch 5 in an axially fast but rotationally free relationship depending on the rotational direction. The outer circumferential surface of the left end of the clutch inner member 22 is integrally formed with the aforementioned pinion 6 which meshes with the ring gear 23 of the engine to drive the same. The clutch inner member 22 thus integrally formed with the pinion 6 is fitted on the left end of the output shaft 4 in a both rotationally and axially moveable relationship.

In an intermediate part of the casing 17 is secured an energization solenoid assembly 24 which surrounds the output shaft 4. The energization solenoid assembly 24 is surrounded by a yoke defined by a cup-shaped holder 25 having bore defined in a bottom plate thereof, and an annular disk 26 serving as an end plate for the cup-shaped holder 25. In a gap defined between the inner circumferential surface of the energization solenoid assembly 24 and the outer circumferential surface of the output shaft 4 is disposed an armature outer member 27 and an armature inner member 28, both made of ferromagnetic material, in a mutually coaxially nested and axially slidable relationship. The left ends of the armature members 27 and 28 oppose the axial inner surface of a central part of an internal radial flange 25*a* forming a bottom portion of the cup-shaped holder 25, and the central part of the internal radial flange 25*a* serves as a magnetic pole for the armature members 27 and 28.

An annular stopper 42 made of synthetic resin is mounted between the holder 25 and the clutch outer member 18 for engaging a returning movement of the pinion 6. The resin stopper 42 is prevented from rotating by engaging a projection formed on a part of the outer periphery thereof with an axial slot formed in the casing 17. The end surface of the stopper 42 facing the energization solenoid assembly 24 is provided with a recess for receiving a projection formed in a coil bobbin of the energization solenoid assembly 24 to thereby prevent the rotation of the energization solenoid assembly 24.

The right end of the armature outer member 27 is connected to a moveable contact plate 8 of the switch unit 7, which is arranged adjacent to a commutator 31 of the electric motor 3, via a connecting rod 30 passed through the top plate 12 of the electric motor 3. The moveable contact plate 8 is attached to the connecting rod 30 so as to be axially movable and is supported by a solenoid assembly spring 32 in a floating relationship so as to be selectively engaged and disengaged with and from a fixed contact plate 34 fixedly attached to a brush stay 33 provided around the commutator 31. The armature outer member 27 is normally urged to the right by a return spring 35 interposed between the armature outer member 27 and the inward radial flange 25*a* formed in the holder 25 of the energization solenoid assembly 24 so as to normally keep the contact plates spaced apart from each other.

The armature inner member 28 is normally urged by a solenoid assembly spring 36, having a smaller spring force than the return spring 21 provided to the clutch outer member 18, in the direction to move away from the top plate 12 and push out the pinion 6. The armature inner member 28 is connected to a shifter member 37 made of a non-magnetic member and having a left end which abuts the right end of the clutch outer member 18.

The energization solenoid assembly 24 is electrically connected to an ignition switch not shown in the drawing via a connector (not shown in the drawing) provided in the switch unit 7.

The fixed contact plate 34 of the switch unit 7 is electrically connected to the positive terminal of a battery not shown in the drawings, and a pigtail 40 which is connected to a brush not shown in the drawing is fixedly attached to the moveable contact plate 8 of the switch unit 7. Positive and negative brushes 41 are provided in pairs, and another pigtail (not shown in the drawing) is connected to a negative terminal of the battery via the casing 17 and a vehicle body not shown in the drawing.

Figure 2:
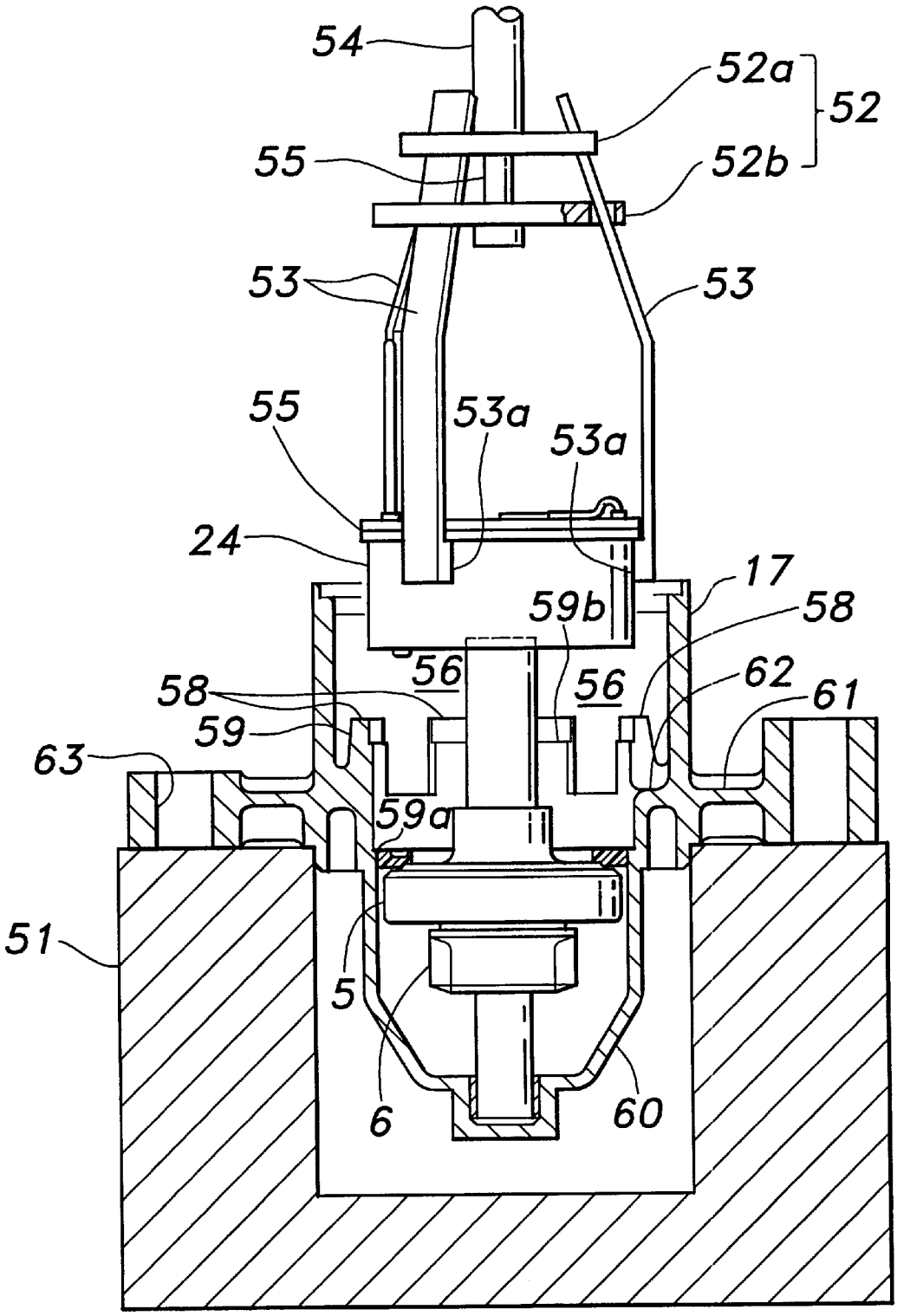
FIG. 2 is a sectional side view showing the mode of assembling the solenoid assembly.

Now the mode of automatically assembling the energization solenoid assembly 24 as the casing 17 in this engine starter is described in follows. According to this process of automatically assembling the energization solenoid assembly 24, as shown in FIG. 2, the output shaft 4 carrying the one-way roller clutch 5 and the pinion 6 thereon is initially assembled in the casing 17, and the casing 17 in this state is placed on an assembling tool 51 in a vertical orientation.

The casing 17 comprises a large diameter portion which has an outer contour substantially continuous from the electric motor 3, and a small diameter portion which includes an annular outer peripheral wall 59 defining a bore for receiving the solenoid assembly 24 and the tapered forward end 60 rotatably supporting the forward end of the output shaft 4. The forward end portion of the large diameter portion of the casing 17 is integrally surrounded by a mounting flange 61 having a pair of mounting holes 63. The large diameter portion and the small diameter portion being integrally joined by an annular web 62 extending substantially in a same plane as the mounting flange 61. This configuration is advantageous because it is suited to be formed by casting, provides a high mechanical strength, and provides a convenient arrangement for mounting the solenoid assembly 24 as described hereinafter.

To automatically assemble the energization solenoid assembly 24 in the casing 17 while holding the energization solenoid assembly 24, an automated assembling machine using a special assembling tool may be used. This assembling tool includes a hand 52 which can be moved vertically by a drive unit not shown in the drawings, and is provided with three fingers 53. The hand 52 comprises a pivot plate 52*a* fixedly secured to a free end portion of a tubular rod 54, and a moveable plate 52*b* fixedly attached to a free end portion of a drive rod 55 which is received inside the tubular rod 54 so as to be axially moveable into and out of the tubular rod 54. The pivot plate 52*a* pivotally supports base ends of the three fingers 53, and the part extending between the base end and an intermediate part of each of the fingers 53 is passed through a corresponding hole formed in the moveable plate 52*b*.

The three fingers 53 are flared from their base ends to their middle parts, and are bent in their middle parts so that the parts of the fingers 53 extending from their middle parts to their free ends extend substantially in parallel with the axial line of the rod 54. Therefore, as the moveable plate 52*b* is moved in the vertical direction, the free ends of the three fingers 53 radially open and close with respect to each other.

The energization solenoid assembly 24 is provided with an external radial flange 55 in a region where the holder 25 and the disk 26 are joined with each other. The free end of each of the fingers 53 is provided with an inwardly directed claw 53*a* which is adapted to engage the radial flange 55 when the finger 53 is placed in such a position as to engage the outer periphery of the holder 25 surrounding the energization solenoid assembly 24. When the three fingers 53 are closed upon each other, the energization solenoid assembly 24 is held and suspended by the three fingers 53. When the moveable plate 52*b* is moved in the reverse direction, and the three fingers 53 are opened up, the energization solenoid assembly 24 is released. In this manner, the energization solenoid assembly 24 can be selectively held by the three fingers 53.

Figure 3:
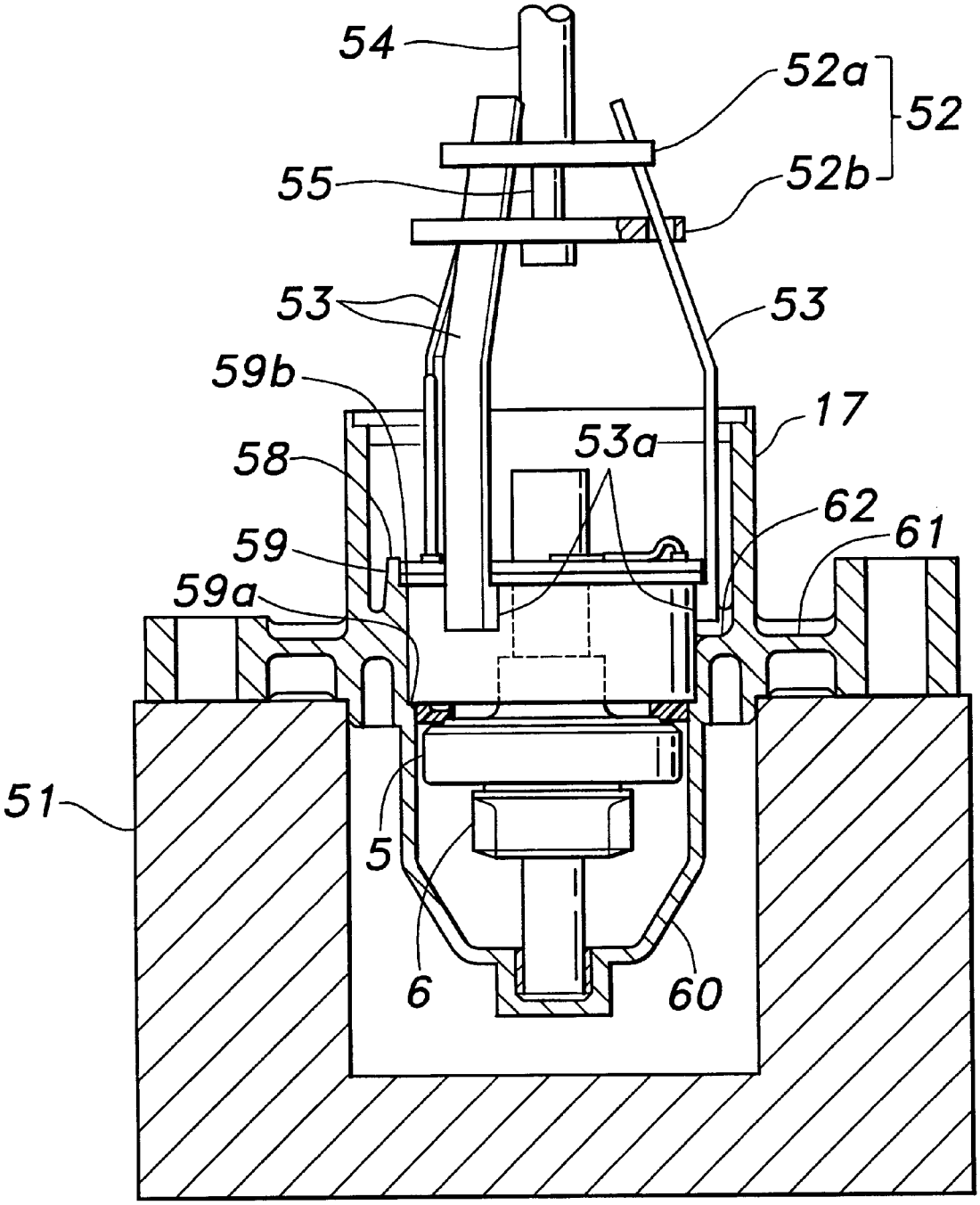
FIG. 3 is a view similar to FIG. 2 showing the assembled state of the solenoid assembly.
Figure 4:
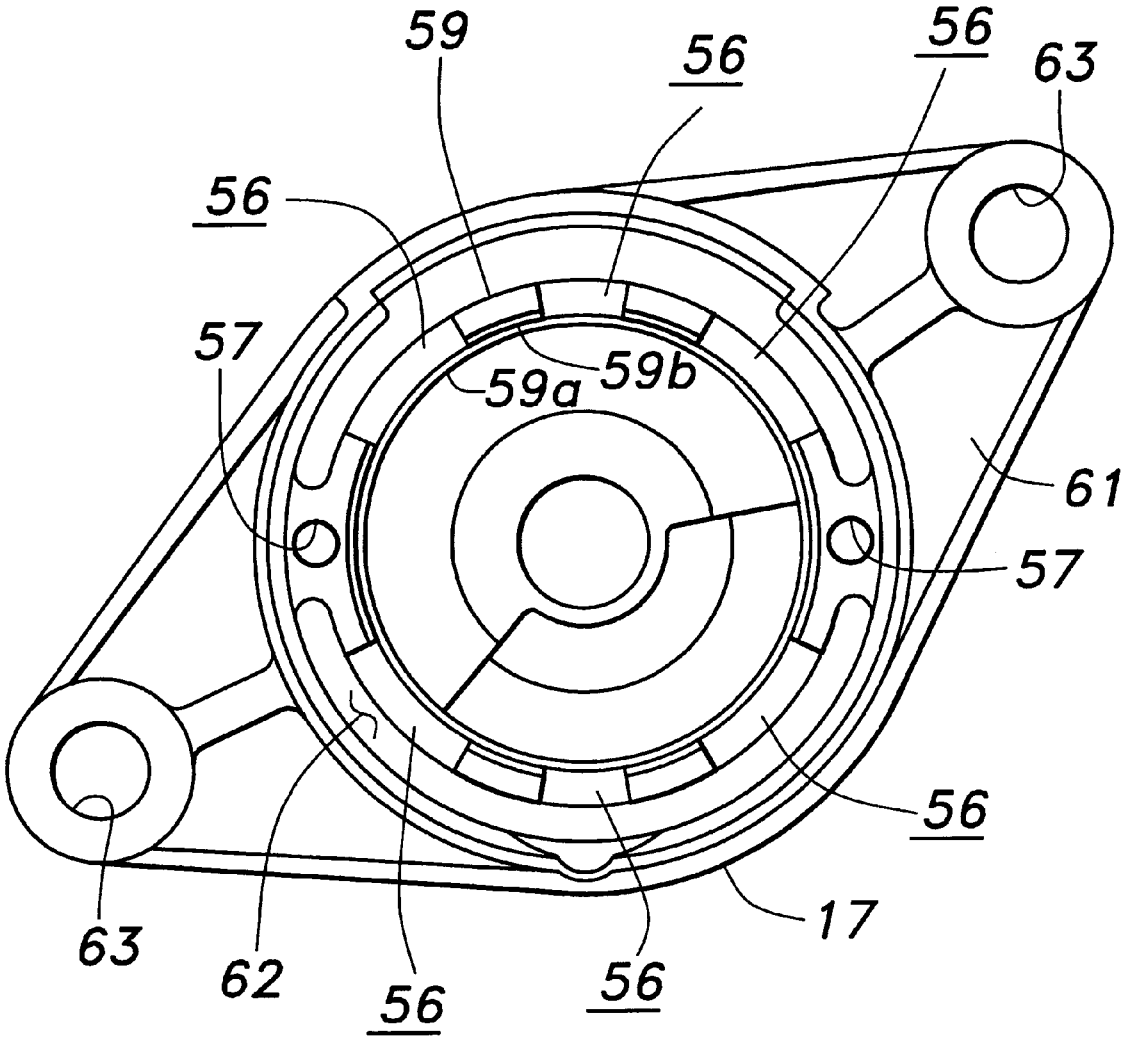
FIG. 4 is an end view showing the casing.

Referring to FIG. 3, the energization solenoid assembly 24 is placed inside the casing 17 by being continually held by the fingers 53 of the hand 52 until the energization solenoid assembly 24 is properly positioned by abutting an annular shoulder 59*a* provided in the inner periphery of the casing 17 or, more particular, the annular outer peripheral wall 59 which extends axially from the annular shoulder 59*a*, and the energization solenoid assembly 24 is radially positioned by the annular outer peripheral wall 59 by being relatively closely received therein via the outer peripheral surface of the holder 25 of the energization solenoid assembly 24. Once the energization solenoid assembly 24 is finally fitted inside the annular outer peripheral wall 59, crimping portions 58 formed in a free end portion of the annular outer peripheral wall 59 are crimped, by a crimping tool not shown in the drawing, radially inward onto the external radial flange 55 so that the energization solenoid assembly 24 may be secured with respect to the axial direction.

The annular outer peripheral wall 59 may be further provided with an annular shoulder 59*b* which is adapted to engage the outer periphery of the external radial flange 55 of the solenoid assembly 24. The provision of the annular shoulder 59*b* provides a firm support for the crimping. Also, the annular shoulder 59*b* may also serve as positioning means for axially positioning the solenoid device 24. If desired, either one of the annular shoulder 59*a* and 59*b* may be omitted.

During the process of assembling the energization solenoid assembly 24 into the casing 17 as described above, the free ends of the fingers 53 may interfere with the annular outer peripheral wall 59 as the energization solenoid assembly 24 is fitted into the annular outer peripheral wall 59. Therefore, according to the present invention, recesses 56 are provided in the parts of the annular outer peripheral wall 59 which may otherwise interfere with the free ends of the fingers 53. The recesses 56 are dimensioned such that the recesses 56 may accommodate the free ends of the fingers 53 holding the energization solenoid assembly 24 until the energization solenoid assembly 24 abuts the annular shoulder 59 as illustrated in FIG. 3. Therefore, the recesses 56 expose the outer circumferential surface of the energization solenoid assembly 24 near the associated axial end or the parts thereof which are adapted to be engaged by the fingers 53.

According to this embodiment, the recesses 56 are provided in six locations, and there are two sets of recesses 56 each including recesses 56 in 120 degree apart arrangement so that the axial free end of the annular outer peripheral wall 59 is shaped like a comb with the recesses 56 and the remaining parts or the crimping portions 58 arranged in an alternating fashion. According to this arrangement, even when there is some offsetting between the fingers 53 and the recesses 56, it is possible to correct such an offsetting with a minimum angular adjustment. In particular, the lead wires from the energization solenoid assembly 24 are required to be properly positioned in view of the relationship with other component parts, and it is possible to achieve both the positioning of the lead wires and the assembling work at the same time by holding the energization solenoid assembly with the lead wires associated with a particular one of the fingers 53, and positioning the fingers 53 with respect to the recesses 56.

In this embodiment, some of the recesses 56 have larger circumferential width than the others. For instance, one of the fingers 53 may have a larger width than the other fingers 53 so that the broader finger 53 may match only a particular one of the recesses 56 having a relatively large width so that the positioning of the lead wires and the positioning of the energization solenoid assembly itself may be conveniently accomplished at the same time. In other words, this arrangement prevents any possibility of mounting the solenoid assembly 24 or the casing 17 in a wrong angular orientation.

The recesses 56 are provided away from the thick-walled portions for forming threaded holes 57 for receiving threaded bolts which join the electric motor 3 with the casing 17 so that the provision of the recesses 56 allows an automatic assembling process using fingers without in any way affecting other assembling arrangements.

The present invention is applicable not only to automatic assembling processes but also to manual assembling processes using fingers as an assembling tool. The present invention can also improve the efficiency of manually assembling solenoid assemblies.

Thus, according to the present invention which is applicable to a process of inserting and assembling a solenoid assembly in a casing, crimping portions for securing the solenoid assembly are defined by a plurality of recesses provided along the peripheral direction so that the fingers of an assembling tool for holding the outer periphery of the solenoid assembly when inserting the solenoid assembly are prevented from interfering with the crimping portions by associating the fingers with the recesses. Because the solenoid assembly is held by the fingers throughout the process of inserting the solenoid assembly, the assembling work can be accomplished in both a reliable and easy manner.

Although the present invention has been described in terms of a preferred embodiment thereof, it is obvious to a person skilled in the art that various alterations and modifications are possible without departing from the scope of the present invention which is set forth in the appended claims.

What we claim is:

1. In an engine starter comprising an electric motor, a pinion casing attached to an axial end of said electric motor, and an annular cylindrical solenoid assembly fitted in said pinion casing;

said pinion casing, comprising:

an open end adapted to be attached to said electric motor;

an annular wall having a base end secured to said pinion casing and a free end extending axially toward said electric motor, said annular wall defining an inner bore receiving said solenoid assembly; and stopper means for limiting movement of said solenoid assembly away from said open end of said pinion casing;

wherein the free end of said annular wall is provided with a plurality of crimping portions separated by a plurality of recesses, said recesses extending along a portion of said inner bore in a direction of an axis of said inner bore said crimping portions of said free end of said annular wall being at least partly crimped onto an axial end of said solenoid assembly facing said open end of said pinion casing.

2. An engine starter according to claim 1, wherein said stopper means comprises an annular shoulder integrally and coaxially defined in said annular wall to engage another axial end of said annular cylindrical solenoid assembly facing away from said open end of said pinion casing.

3. An engine starter according to claim 1, wherein said solenoid device is provided with an external radial flange near an axial end thereof facing said open end of said pinion casing, and said stopper means comprises an annular shoulder integrally and coaxially defined in a part of said annular wall adjacent to said free end thereof to engage the external radial flange.

4. An engine starter according to claim 1, wherein said annular wall is disposed coaxially with said electric motor.

5. An engine starter according to claim 1, wherein said annular wall comprises a relatively thin-walled section, and a relatively thick-walled section, said thick-walled section being formed with a bore for receiving a threaded bolt for attaching said pinion casing to said electric motor.

6. An engine starter according to claim 1, wherein at least one of said recesses has a broader circumferential width than remaining ones of said recesses.

7. An engine starter according to claim 1, wherein said pinion casing comprises a large diameter portion which defines a substantially continuous outer profile with said electric motor, a small diameter portion which includes said annular wall and an extension therefrom having a tapered forward end rotatably supporting an output shaft of said engine starter carrying a pinion, and a mounting flange integrally formed around a forward end portion of said large diameter portion, said large diameter portion and said small diameter portion being integrally joined by an annular web extending substantially in a same plane as said mounting flange.

* * * * *